US007517193B2

(12) United States Patent
Higashimori

(10) Patent No.: US 7,517,193 B2
(45) Date of Patent: Apr. 14, 2009

(54) CENTRIFUGAL COMPRESSOR AND MANUFACTURING METHOD FOR IMPELLER

(75) Inventor: Hirotaka Higashimori, Nagasaki-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 556 days.

(21) Appl. No.: 11/085,245

(22) Filed: Mar. 22, 2005

(65) Prior Publication Data

US 2005/0260074 A1 Nov. 24, 2005

(30) Foreign Application Priority Data

Mar. 23, 2004 (JP) ..... 2004-084329
Feb. 8, 2005 (JP) ..... 2005-032121

(51) Int. Cl.
*B63H 1/16* (2006.01)

(52) U.S. Cl. ..... 416/188; 416/185

(58) Field of Classification Search ..... 416/176, 416/177, 183, 185, 188, 182
See application file for complete search history.

(56) References Cited

U.S. PATENT DOCUMENTS 2,962,941 A * 12/1960 Stein et al. ..... 409/122
3,989,406 A 11/1976 Bliss
4,208,169 A * 6/1980 Becker et al. ..... 416/185
5,730,582 A 3/1998 Heitmann
7,063,508 B2 * 6/2006 Higashimori et al. ..... 416/185

FOREIGN PATENT DOCUMENTS

| | | |
|---|---|---|
| DE | 3816674 A1 | 11/1989 |
| JP | SHO 32-2429 | 4/1957 |
| JP | 61-109608 A | 5/1986 |
| JP | 08-049696 | 2/1996 |
| JP | 2000-135616 A | 5/2000 |
| JP | 2002-276593 | 9/2002 |

OTHER PUBLICATIONS

European Search Report dated May 29, 2007.
Japanese Patent Office, Office Action issued Aug. 29, 2008.

* cited by examiner

*Primary Examiner*—Edward Look
*Assistant Examiner*—Dwayne J White
(74) *Attorney, Agent, or Firm*—Lowe Hauptman Ham & Berner

(57) ABSTRACT

On a suction surface side of a blade in an impeller, a convex portion is formed to assume a curved line from a front edge portion to a throat portion substantially in the middle in a radial direction, and this convex portion is formed to be flat assuming a curved line from the throat portion toward a rear edge portion, whereby this convex portion is formed in a position where a relative inlet velocity of fluid into the impeller is Mach number Ma≅1.

8 Claims, 14 Drawing Sheets

CENTRIFUGAL COMPRESSOR AND MANUFACTURING METHOD FOR IMPELLER

RELATED APPLICATIONS

The present application is based on, and claims priority from, Japanese Application Number 2004-084329, filed Mar. 23, 2004, and Japanese Application 2005-032121, filed Feb. 8, 2005, the disclosures of which are hereby incorporated by reference herein in their entirety.

BACKGROUND OF THE INVENTION

1) Field of the Invention

The present invention relates to a centrifugal compressor that pressurizes fluid to change the fluid to compressed fluid, and in particular to an impeller for pressurizing fluid and a manufacturing method for the impeller.

2) Description of the Related Art

FIG. 20 is a sectional view of an impeller in a conventional centrifugal compressor, FIG. 21 is a sectional view along line XXI-XXI in FIG. 20, FIG. 22 is a schematic diagram of shapes in respective positions in a blade of a conventional impeller, and FIG. 23 is a graph of a flow rate per a unit area with respect to a relative inlet velocity of fluid in the conventional centrifugal compressor.

A general centrifugal compressor is constituted in which an impeller having plural blades is supported to rotate freely in a casing, an inlet passage along an axial direction with respect to this impeller is formed, and a diffuser along a radial direction is formed. Therefore, when the impeller is rotated by a not-shown motor, fluid is drawn into the casing through the inlet passage, pressurized in a course of flowing to pass the impeller, and then discharged to the diffuser, in which a dynamic pressure of the compressed fluid is converted into a static pressure.

In such a centrifugal compressor, as shown in FIGS. 20 and 21, an impeller 001 includes a hub 003 fixed to a rotary shaft 002 and plural blades 004 fixed in a radial shape in an outer periphery of this hub 003. Usually, when the blades 004 of this impeller 001 is designed, a method of determining an outer peripheral side shape (a blade shape on a shroud side) and an inner peripheral side shape (a blade shape on a hub side) in the blades 004 and determining a shape of the entire blades by connecting both the shapes with a straight line is adopted.

When the centrifugal compressor described above is applied as a centrifugal compressor having a high pressure ratio, a velocity of flow of fluid sucked by the impeller 001 exceeds a sound velocity. For example, as shown in FIG. 20, the velocity of flow is Mach number Ma≅0.7 on a hub side (H), Mach number Ma≅1.0 in the middle (M), and Mach number Ma≅1.3 on a shroud side (S). Therefore, a transonic impeller having a subsonic velocity on the hub side and a supersonic velocity on the shroud side is constituted, and a shock wave is generated, in particular, from the center to the shroud side. When this shock wave is large, there is a problem in that the flow separates and the impeller stalls, whereby efficiency and performance fall.

Thus, as a technology for solving such a problem, for example, there is a patent document 1 (Japanese Patent Application Laid-Open No. H08-049696) indicated below. In the technology described in this patent document 1, a meridional plane shape of an impeller blade is set to a shape in which a corner on an outer peripheral side of an end of a leading edge is cut diagonally with respect to the leading edge such that a magnitude of a velocity component, which flows into a blade vertically, of an airflow is smaller than a critical velocity of generation of a shock wave. This controls a relative inlet velocity of the airflow to be less than the velocity of generation of the shock wave and prevents the generation of the shock wave.

Incidentally, when the impeller 001 of the conventional centrifugal compressor is applied as a centrifugal compressor having a high pressure ratio, the middle (M) of the impeller 001 is set such that a throat width of the blades 004 adjacent to each other changes linearly between the shroud side (S) and the hub side (H). A bend of the blades 004 is designed such that a deflection angle on the hub side is large compared with that on the shroud side in order to obtain a same pressure increase on the shroud side and the hub side. As a result, as shown in FIG. 22, in the impeller 004, throat widths $W_{Sth}$, $W_{Mth}$, and $W_{Hth}$ in a throat portion B are large compared with imaginary blade passage widths $W_S$, $W_M$, and $W_H$ in a leading edge portion A. In addition, a ratio of a change in a flow path area from the leading edge portion A to the throat portion B is large on the hub side and small on the shroud side.

Therefore, even if the meridional plane shape of the impeller blade is formed in the shape in which the corner on the outer peripheral side of the end of the leading edge is cut diagonally as in the patent document 1 described above, it is impossible to reduce a shock wave that is generated following the change in the flow path area.

In short, when the flow path area increases due to deflection of the blade, a Mach number increases in the middle M and on the shroud side S of the blade in a supersonic area in which a velocity of flow exceeds Mach number Ma≅1.0, and a Mach number decreases on the hub side H of the blade in a subsonic area in which a velocity of flow is smaller than Mach number Ma≅1.0. Since the flow path area is related to a flow rate per a unit area, a relation between the Mach number and the flow rate is a parabolic relation as shown in a graph in FIG. 23.

Therefore, as shown in FIG. 23, when fluid is sucked, since the flow path area increases when the fluid flows from the leading edge portion A (●) to the throat portion B (Δ), a flow rate per unit area Q at that point decreases by an amount of change on the hub side (H) $\Delta Q_H$, Then, the Mach number Ma decreases from $Ma_{HA}$ to $Ma_{HB}$ on the hub side (H). Whereas a flow rate per unit area Q decreases by an amount of change in the middle (M) $\Delta Q_M$, and by an amount of change on the shroud side (S) $\Delta Q_S$, the Mach number Ma increases from $Ma_{MA}$ to $Ma_{MB}$ in the middle (M) and from $Ma_{SA}$ to $Ma_{SB}$ on the shroud side (S). In this case, as an amount of change of flow rate per unit area $\Delta Q_M$ is larger than $\Delta Q_S$, it is understood that an amount of increase in Mach number in the middle $\Delta Ma_M$ is larger than an amount of increase in Mach number on the shroud side $\Delta Ma_S$.

In this way, when fluid flows from the leading edge portion A to the throat portion B in the centrifugal compressor having a high pressure ratio, since a flow rate per unit area decreases following an increase in a flow path area, a Mach number increases largely, in particular, in the middle in a radial direction of the blade. Therefore, a large shock wave is generated in this part, efficiency and performance of the impeller fall, efficiency of the compressor itself falls, and a range of a flow rate, in which the compressor can operate stably, decreases.

SUMMARY OF THE INVENTION

It is an object of the present invention to solve at least the problems in the conventional technology.

The centrifugal compressor according to the present invention, the impeller mounted with the plural blades radially is disposed rotatively in the inside of the casing, and the throat portion on the suction surface side in each blade is formed in a convex shape in a direction of blade height. Thus, a throat width is reduced, and a change in a flow path area in a direction of flow of fluid decreases and a change in a flow rate also decreases, along middle height of blade where Mach number is near unity. Therefore, an increase in a Mach number is controlled and a magnitude of a shock wave to be generated is also controlled, flow separation and distortion of the fluid decrease, and fall in efficiency and performance of the impeller is prevented. As a result, since operation efficiency is improved, it is possible to improve efficiency and expand a range of a flow rate that the centrifugal compressor can operate stably.

The manufacturing method for an impeller according to the present invention, in the centrifugal compressor in which the impeller mounted with plural blades radially is disposed rotatively in the inside of the casing, in a state in which a rotation axis of a cutter is inclined at a predetermined angle to the rear edge side of the blade, the suction surface side in the blade is cut from the front edge side of the blade to form the throat portion relatively in a convex shape. Thus, it is possible to perform machining of a blade surface easily in a short time and improve workability.

The other objects, features, and advantages of the present invention are specifically set forth in or will become apparent from the following detailed description of the invention when read in conjunction with the accompanying drawings.

DETAILED DESCRIPTION

Exemplary embodiments of a centrifugal compressor and a manufacturing method for an impeller according to the invention will be explained in detail based on the drawings. Note that the invention is not limited by the embodiments.

Figure 1:
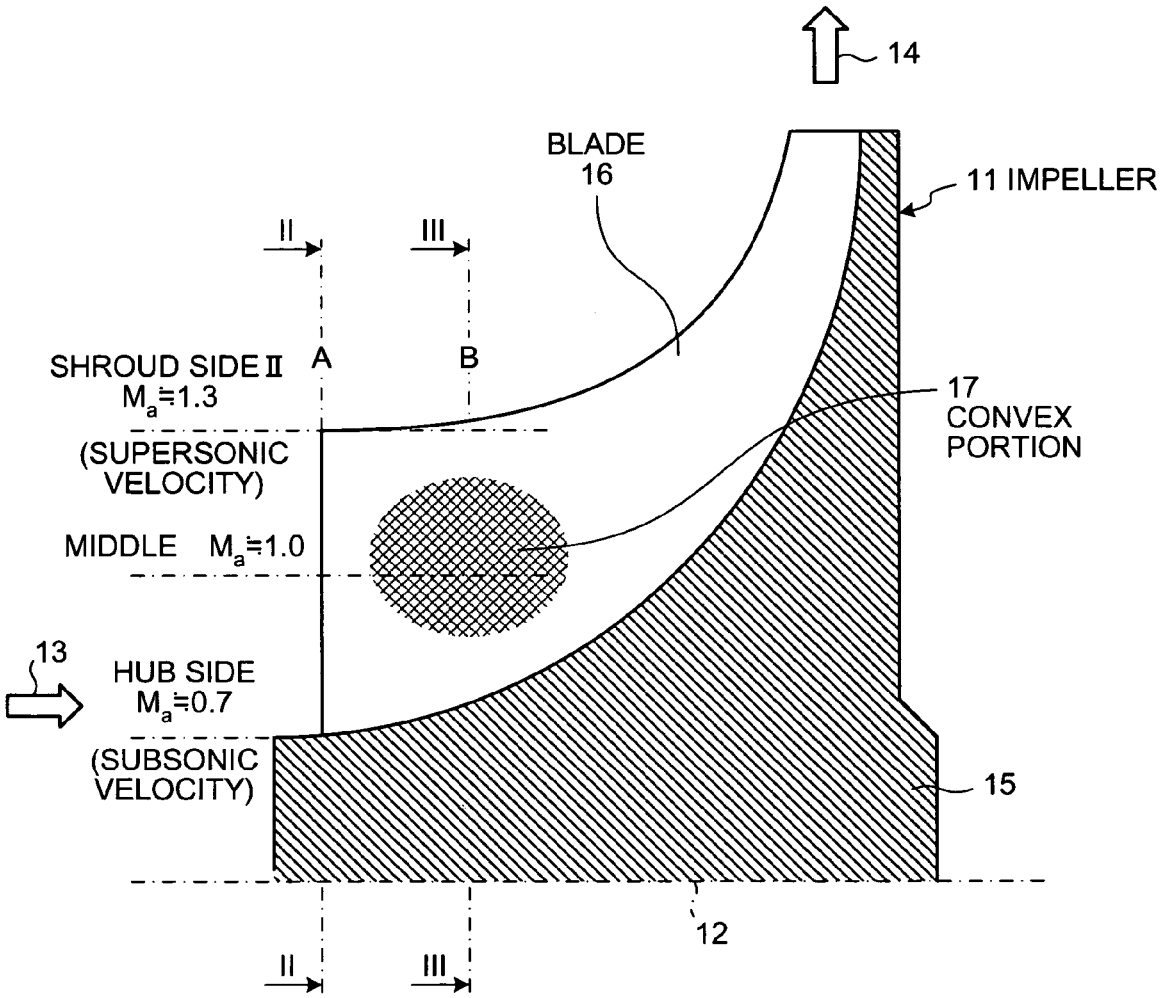
FIG. 1 is a main part sectional view of a centrifugal compressor according to a first embodiment of the invention.
Figure 2:
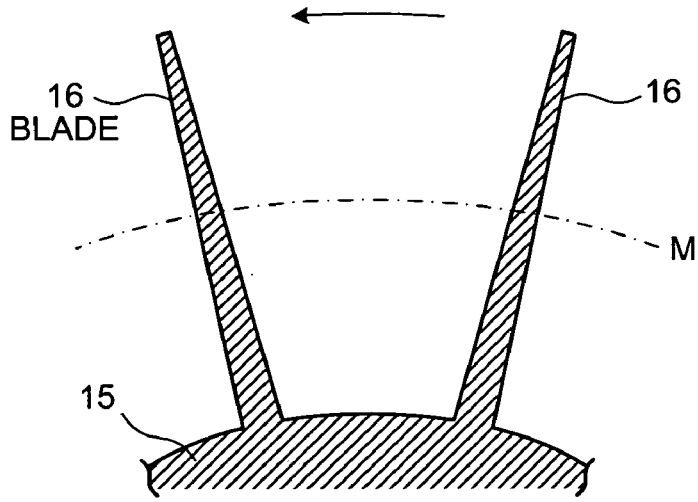
FIG. 2 is a sectional view along line II-II in FIG. 1.
Figure 3:
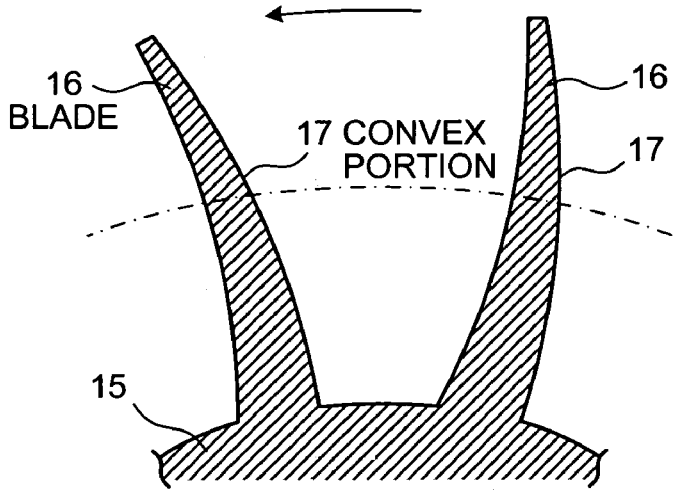
FIG. 3 is a sectional view along III-III in FIG. 1.
Figure 4:
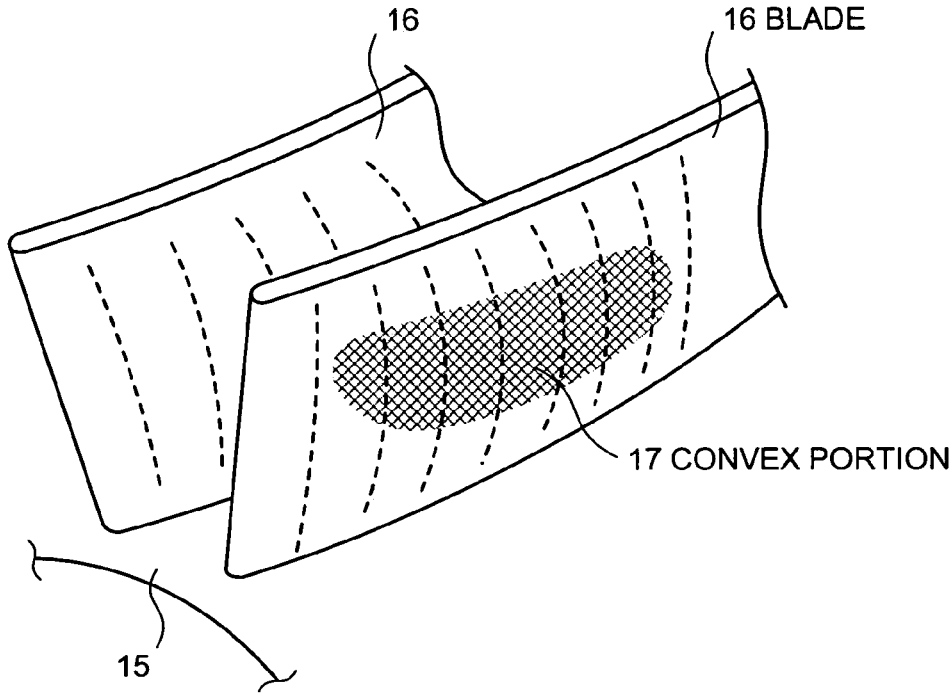
FIG. 4 is a schematic diagram of an impeller in the centrifugal compressor according to the first embodiment.
Figure 5:
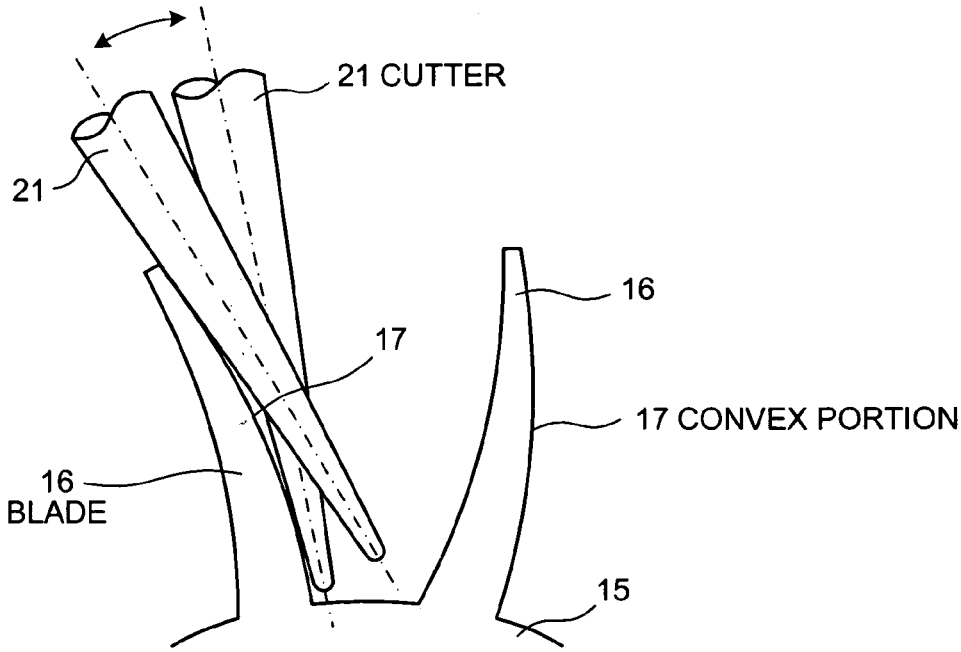
FIG. 5 is a schematic diagram of a manufacturing method for the first embodiment of the impeller.
Figure 6:
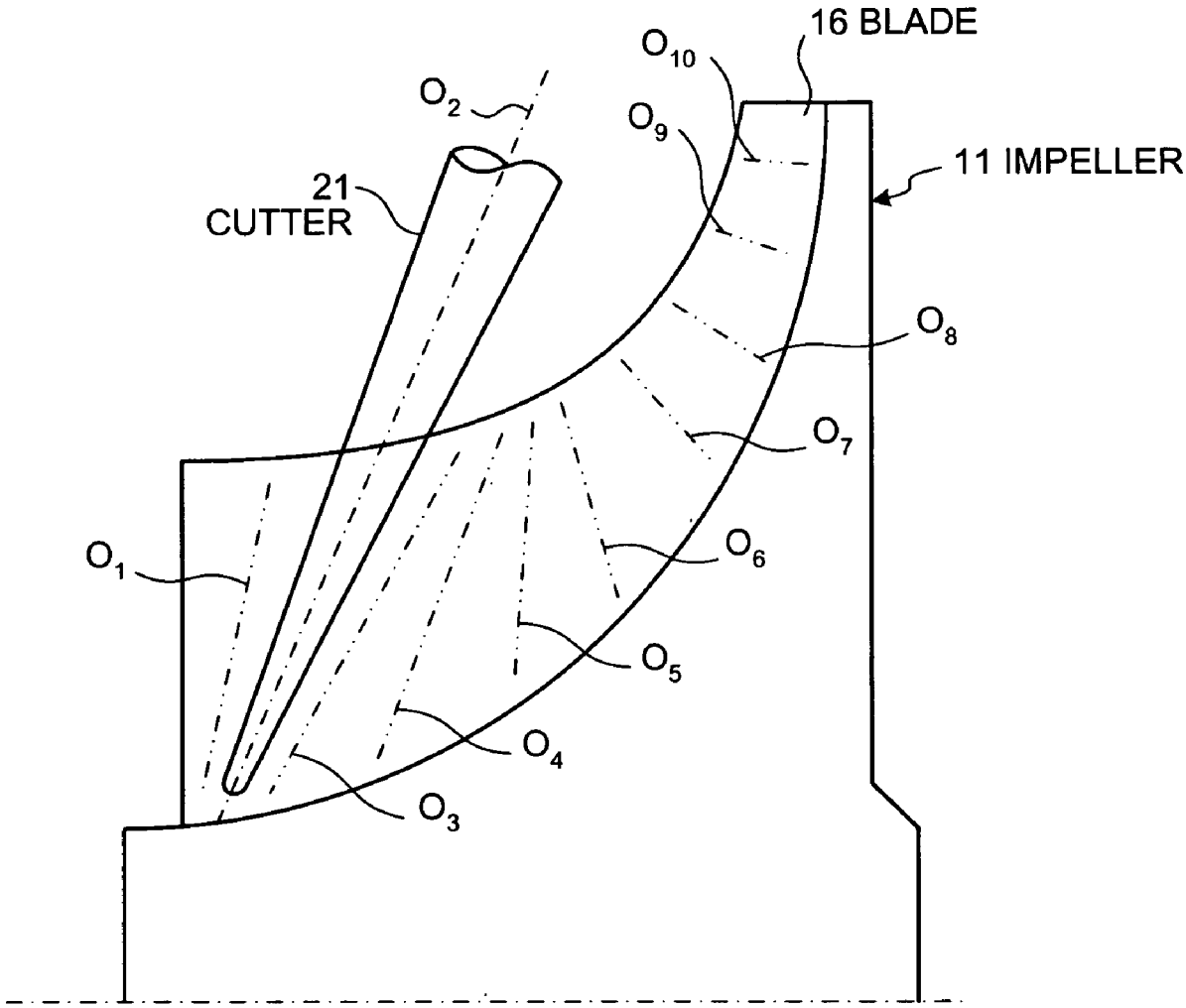
FIG. 6 is a schematic diagram of a machining procedure for the impeller.
Figure 7:
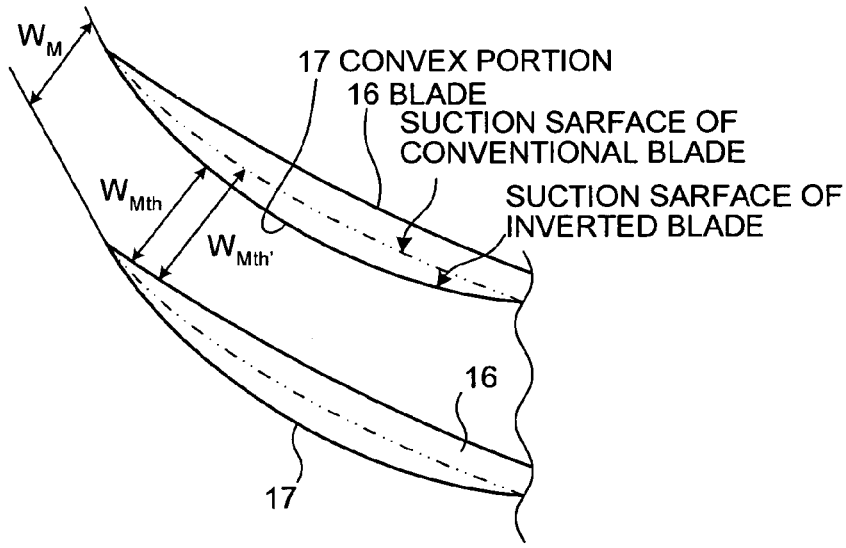
FIG. 7 is a schematic diagram of a shape in the middle height in a blade of the impeller according to the first embodiment.
Figure 8:
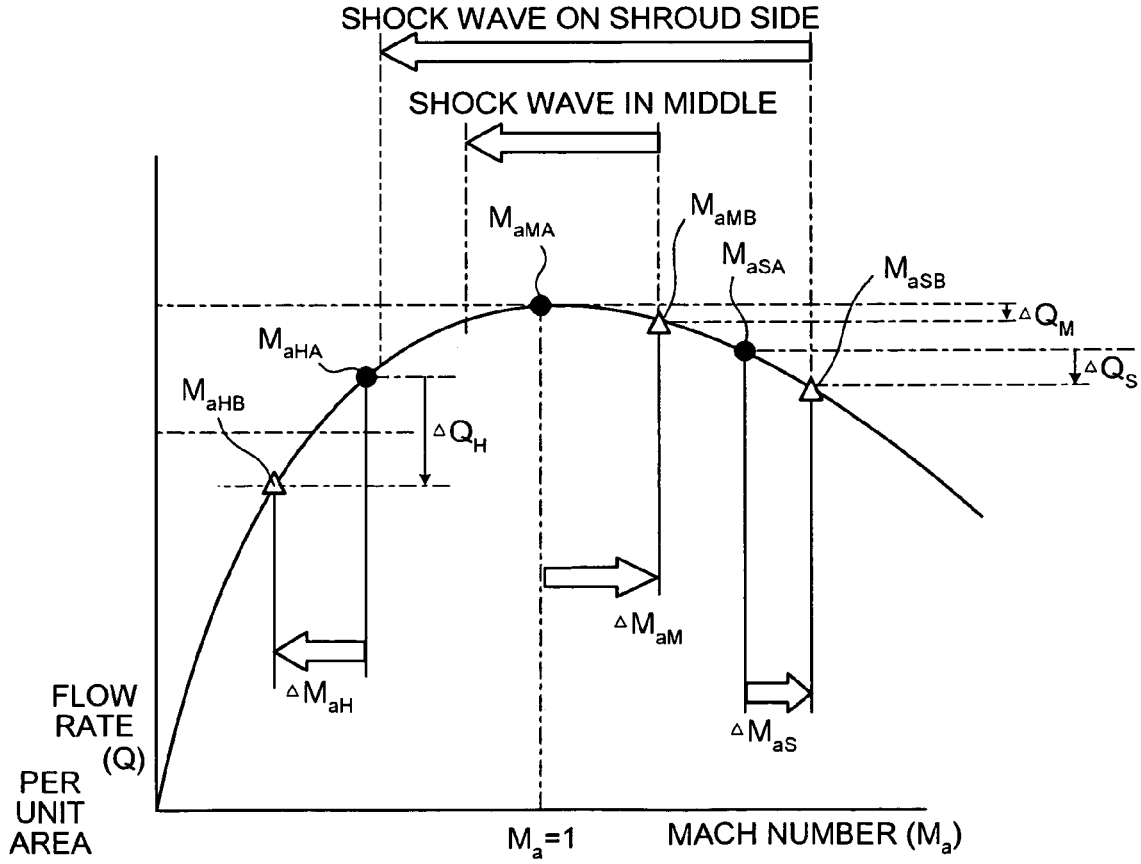
FIG. 8 is a diagram of a flow rate per a unit area with respect to a relative inlet Mach number of fluid in the centrifugal compressor according to the first embodiment.

FIG. 1 is a main part sectional view of a centrifugal compressor according to a first embodiment of the invention. FIG. 2 is a sectional view along line II-II in FIG. 1. FIG. 3 is a sectional view along line III-III in FIG. 1. FIG. 4 is a schematic diagram of an impeller in the centrifugal compressor according to the first embodiment. FIG. 5 is a schematic diagram of a manufacturing method for an impeller in the centrifugal compressor according to the first embodiment. FIG. 6 is a schematic diagram of a machining procedure for the impeller. FIG. 7 is a schematic diagram of a shape in the middle in a blade of the impeller according to the first embodiment. FIG. 8 is a graph of a flow rate per a unit area with respect to a relative inlet velocity of fluid in the centrifugal compressor according to the first embodiment.

As shown in FIGS. 1 to 4, the centrifugal compressor according to this embodiment is constituted in which an impeller 11 is supported by a rotary shaft 12 to rotate freely in a not-shown casing, an intake passage 13 along an axial direction with respect to this impeller 11 is formed, and a diffuser 14 along a radial direction is formed. Therefore, when the impeller 11 is rotated by a not-shown motor, fluid is drawn into the casing through the inlet passage 13, pressurized in a course of flowing to pass the impeller, and then discharged to the diffuser 14, in which a dynamic pressure of the compressed fluid is converted into a static pressure.

In such a centrifugal compressor, the impeller 11 is constituted in which plural blades 16 are fixed radially in an outer periphery of a hub 15 fixed to the rotary shaft 12. In an overall shape of the blades 16, an outer peripheral side shape (a blade shape on a shroud side) and an inner peripheral side shape (a blade shape on a hub side) are determined, and a middle part shape is determined by connecting both the shapes with a straight line.

The centrifugal compressor of this embodiment is a centrifugal compressor applicable to a high pressure ratio, and a velocity of a flow of fluid sucked by the impeller 11 exceeds a sound velocity. In short, it is assumed that, in the blades 16 of the impeller 11, the velocity of a flow is Mach number $Ma \cong 0.7$ on a hub side (H), Mach number $Ma \cong 1.0$ in the middle (M), and Mach number $Ma \cong 1.3$ on a shroud side (S). Therefore, a transonic impeller 11 having a subsonic velocity on the hub side and a supersonic velocity on the shroud side is constituted. In such a transonic impeller 11, in general, since a throat width of a throat portion B increases with respect to a imaginary blade passage width of a front edge portion A due to deflection of the blades 16 to increase a flow path area, there is a problem in that a flow rate per unit area decreases to increase a Mach number, a shock wave is generated, in particular, from the middle to the shroud side, and efficiency and performance fall.

Thus, in this embodiment, in the centrifugal compressor constituted in this way, in each of the blades 16, a throat portion on a suction surface side is formed to become relatively convex in a cross section in a blade height direction (blade radius direction). In short, on a suction surface (a rear surface in a rotating direction) in the blade 16, a convex portion 17 is formed to gradually become convex assuming a curved line (arc shape) from the front edge portion A to the throat portion B. This convex portion 17 is formed to gradually become plane from the throat portion B toward the rear edge portion. Then, this convex portion 17 is formed substantially in the middle in a radial direction of the blade 16, that is, in a part near a part where a relative inlet velocity of fluid into the impeller 11 is Mach number Ma≅1.

Figure 12:
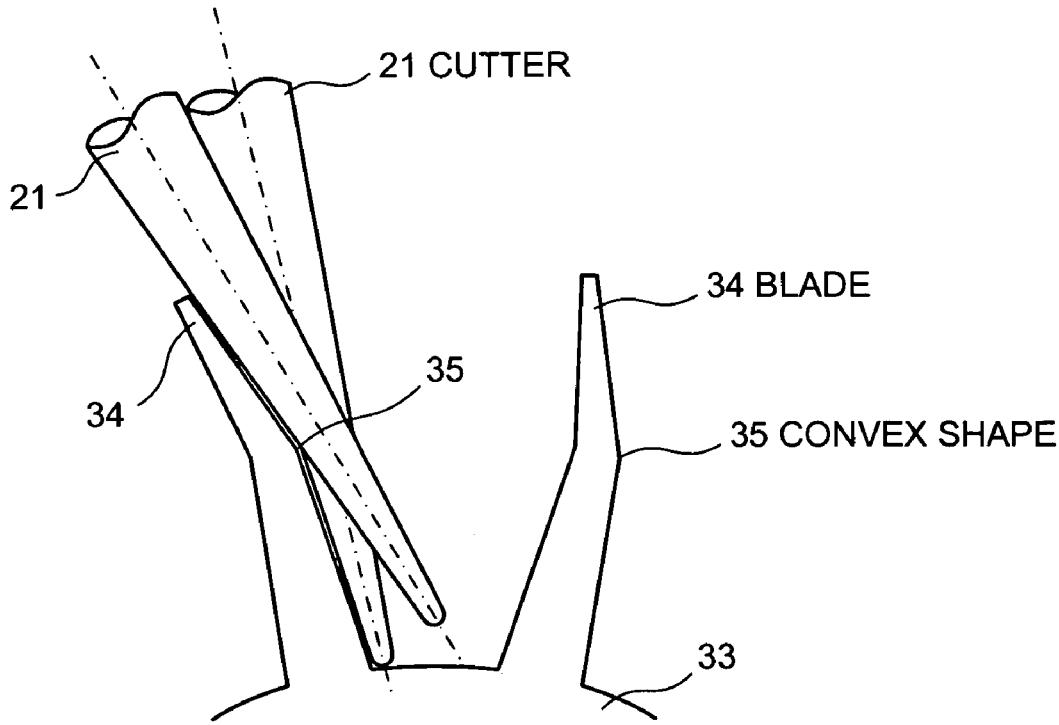
FIG. 12 is a schematic diagram of a manufacturing method for the impeller in the centrifugal compressor according to the second embodiment.

In this case, as shown in FIG. 12 in detail, the blade 16 assumes a linear shape along the radial direction in the front edge portion A, and both a pressure surface side and a suction surface side thereof are flat. However, as shown in FIG. 3 in detail, the blade 16 assumes a curved shape bent to the front in the rotating direction, and the pressure surface side is formed in a concave shape and the suction surface side is formed in a convex shape.

Incidentally, the blade 16 having the convex portion 17 in the throat portion B on the suction surface side is manufactured by a method to be explained below. As shown in FIGS. 5 and 6, a cutter 21 formed to be tapered is used to, in a state in which a rotation axis O thereof is inclined at a predetermined angle to a rear edge side of the blade 16, cut the suction surface side in the blade 16 from the front edge portion A of the blade 16, form the throat portion B in a convex shape (convex portion 17), and cut the blade 16 to the rear edge side. In other words, in a state in which the cutter 21 is rotated at a predetermined velocity, as shown in FIG. 6, while the rotation axis O is moved to positions $O_1$, $O_2$, . . . $O_{10}$ or as shown in FIG. 5, the cutter 21 is swung continuously in a thickness direction, the surface of the blade 16 is cut to form the throat portion B in a convex shape.

In this way, in the impeller 11 according to this embodiment, the convex portion 17 is formed in the throat portion B on the suction surface side in the blade 16, whereby, as shown in FIG. 7, a throat width WMth in the middle of the throat portion B is small compared with a conventional blade width (throat width) WMth', and an amount of change (amount of increase) of a flow path area from the front edge portion A to the throat portion B is reduced.

Figure 23:
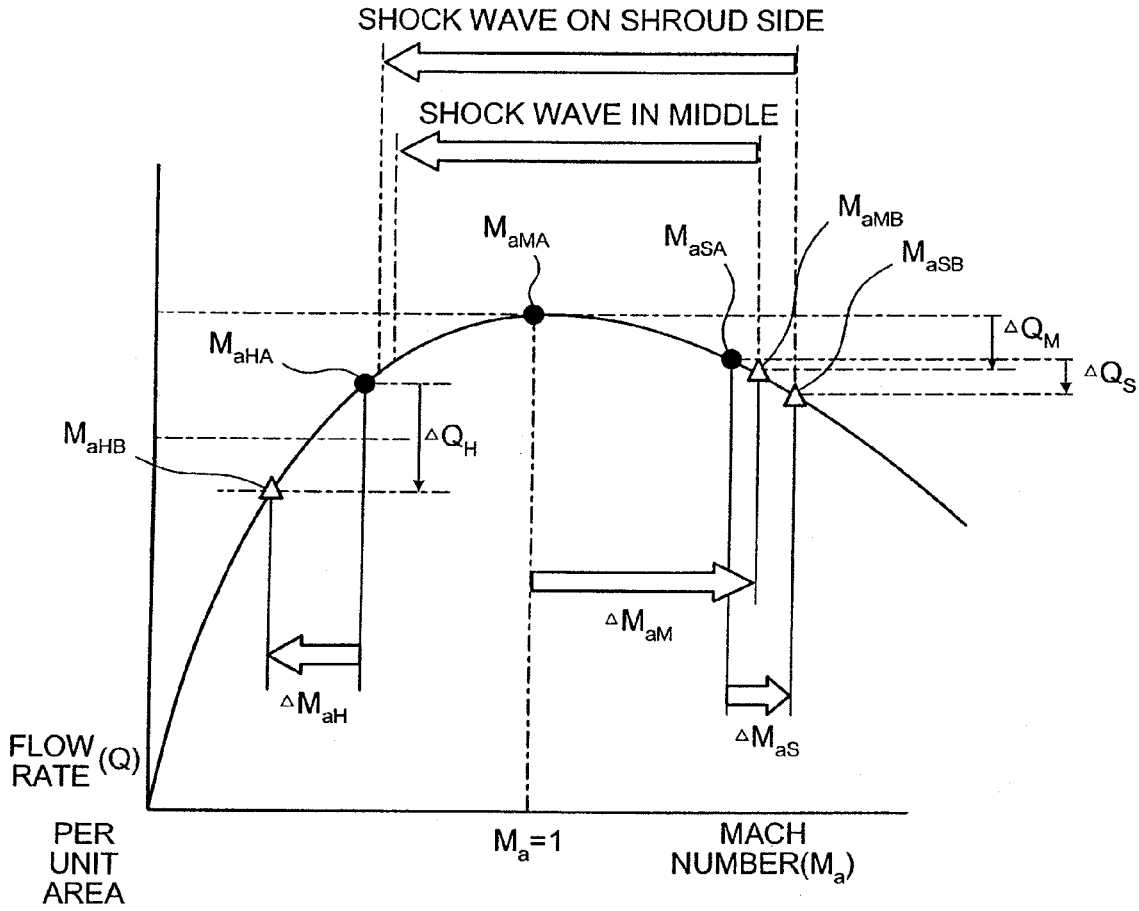
FIG.23 (PRIOR ART)
FIG. 23 is a graph of a flow rate per a unit area with respect to a relative inlet Mach number of fluid in the conventional centrifugal compressor.

Therefore, as shown in FIG. 8, when fluid is sucked, since the flow path area increases when the fluid flows from the leading edge portion A (●) to the throat portion B (Δ), a flow rate per unit area Q at that point decreases by an amount of change on the hub side (H) $\Delta Q_H$, Then, the Mach number Ma decreases from $Ma_{HA}$ to $Ma_{HB}$ on the hub side (H). Whereas a flow rate per unit area Q decreases by an amount of change in the middle (M) $\Delta Q_M$, and by an amount of change on the shroud side (S) $\Delta Q_S$, the Mach number Ma increases from $Ma_{MA}$ to $Ma_{MB}$ in the middle (M) and from $Ma_{SA}$ to $Ma_{SB}$ on the shroud side (S). In this case, since the convex portion 17 is formed in the throat portion B in the middle (M), an amount of change (amount of increase) of a flow path area from the front edge portion A to the throat portion B is small, and an amount of change (amount of decrease) ΔQM of the flow rate Q is also small. As a result, an amount of increase in Mach number in the middle (M) ΔMaM decreases remarkably compared with that in the conventional technology (FIG. 23).

In this way, in the centrifugal compressor according to the first embodiment, on the suction surface side of the blade 16 in the impeller 11, the convex portion 17 is formed to assume a curved line from the front edge portion A to the throat portion B substantially in the middle in the radial direction. This convex portion 17 is formed to be flat assuming a curved line from the throat portion B toward the rear edge portion, whereby this convex portion 17 is formed in a position where a relative inlet velocity of fluid into the impeller 11 is Mach number Ma≅1.

Therefore, the throat width is reduced in the middle of the impeller 11, a change in a flow path area in a direction of a flow of fluid is reduced, and a change in a flow rate per unit area is also reduced. Thus, an increase in a Mach number is controlled and a magnitude of a shock wave to be generated is also controlled, flow separation and distortion of a flow of the fluid decrease, and fall in efficiency and performance of the impeller 11 is prevented. As a result, since operation efficiency is improved, it is possible to improve efficiency and expand a range of a flow rate that the centrifugal compressor is can operate stably.

In addition, the cutter 21 formed to be tapered is applied to, in a state in which a rotation axis O thereof is inclined at a predetermined angle to the rear edge side of the blade 16, cut the suction surface side in the blade 16 from the front edge portion A of the blade 16 toward the throat portion B, whereby the throat portion B is formed in a convex shape (convex portion 17). Therefore, it is possible to perform machining of the suction surface of the blade 16 easily and in a short time and improve workability.

Figure 9:
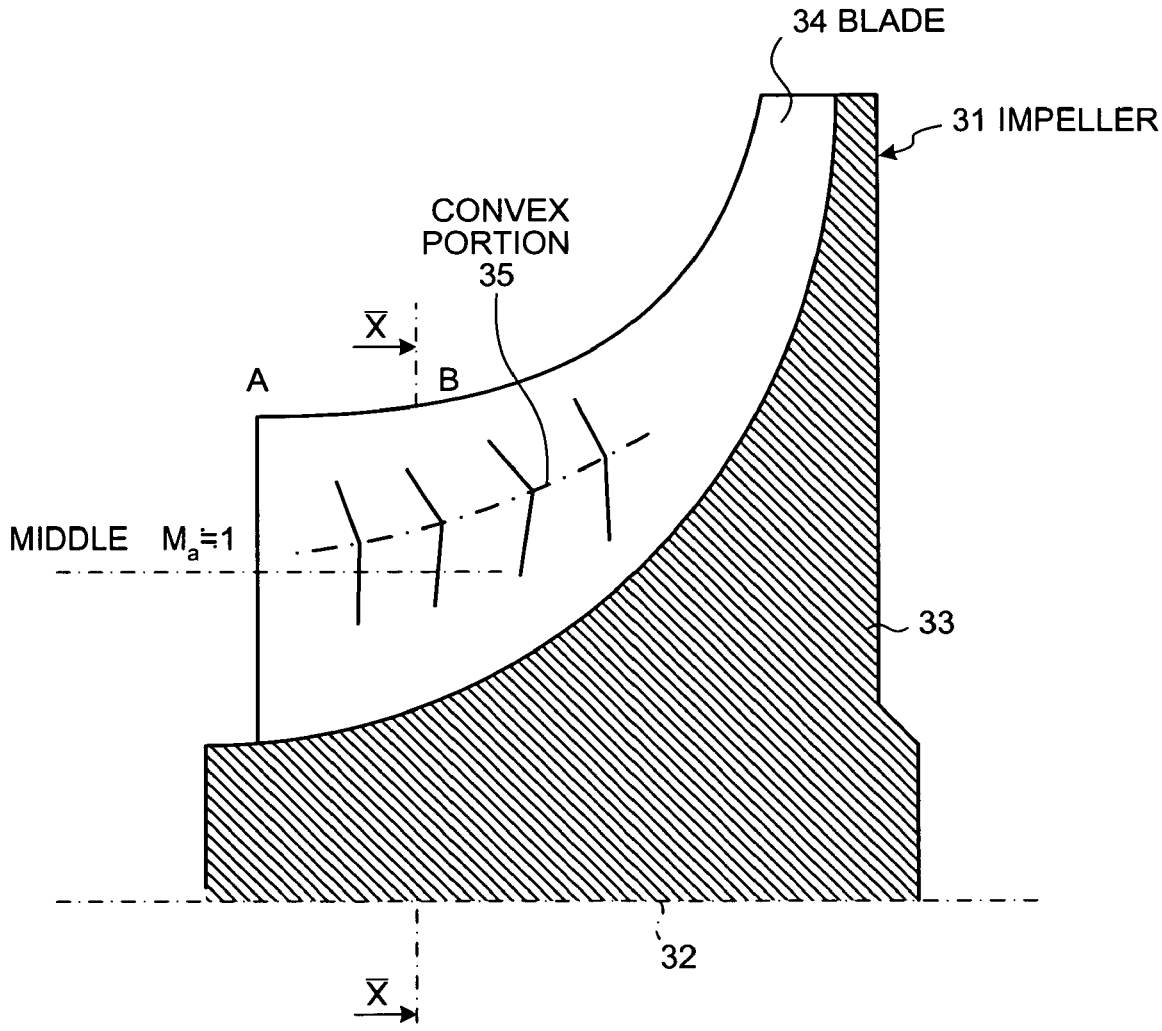
FIG. 9 is a main part sectional view of a centrifugal compressor according to a second embodiment of the invention.
Figure 10:
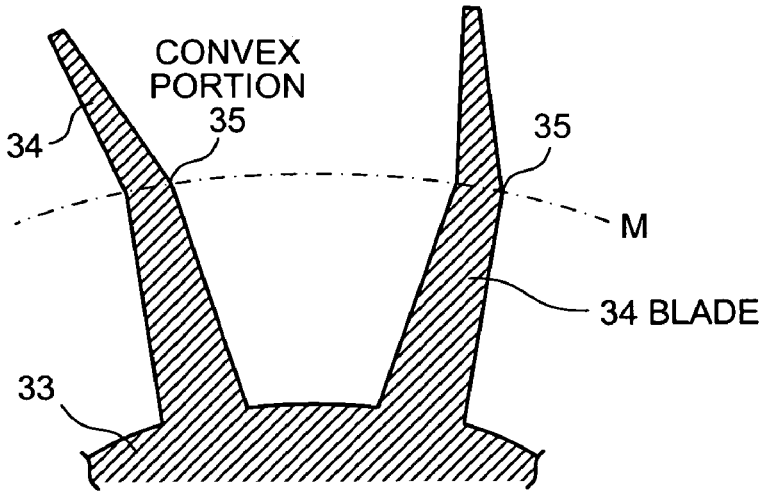
FIG. 10 is a sectional view along line X-X in FIG. 9.
Figure 11:
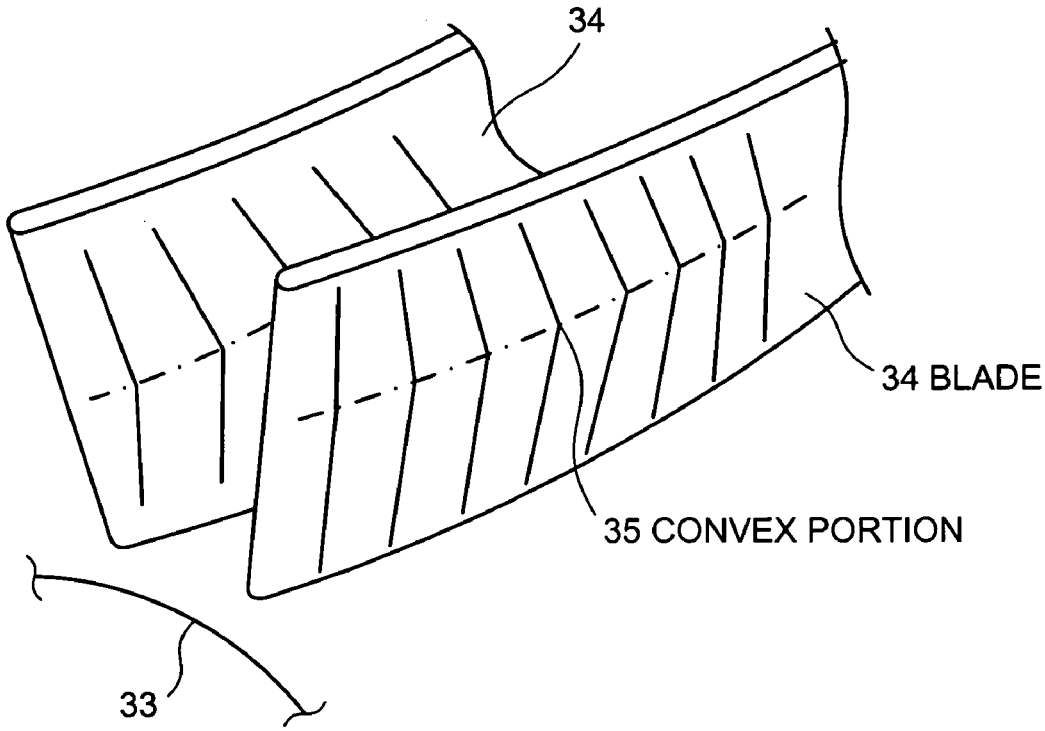
FIG. 11 is a schematic diagram of an impeller in the centrifugal compressor according to the second embodiment.

FIG. 9 is a main part sectional view of a centrifugal compressor according to a second embodiment of the invention. FIG. 10 is a sectional view along line X-X in FIG. 9. FIG. 11 is a schematic diagram of an impeller in the centrifugal compressor according to the second embodiment. FIG. 12 is a schematic diagram of a manufacturing method for the impeller in the centrifugal compressor according to the second embodiment. Note that members having the same functions as those explained in the embodiment described above will be denoted by the identical reference numerals and signs and will not be explained repeatedly.

In the centrifugal compressor according to the second embodiment, as shown in FIGS. 9 to 11, an impeller 31 is constituted in which plural blades 34 are fixed radially in an outer periphery of a hub 33 fixed to a rotary shaft 32. On a suction surface in the blade 34 of this impeller 31, a convex portion 35 is formed to gradually become convex assuming a curved line (arc shape) from the front edge portion A to the throat portion B, and this convex portion 35 is formed to gradually become plane from the throat portion B to the rear edge portion. Then, this convex portion 35 is formed to become a ridge substantially in the middle in the radial direction of the blade 34, that is, along a line on which a relative inlet velocity of fluid into the impeller 31 is Mach number Ma≅1.

In this case, the blade 34 assumes a linear shape along the radial direction in the front edge portion A, and both a pressure surface side and a suction surface side thereof are flat. However, as shown in FIG. 10 in detail, the blade 34 assumes a curved shape bent to the front in the rotating direction, and the pressure surface side is formed in a concave shape and the suction surface side is formed in a convex shape.

Incidentally, the blade 34 having the convex portion 35 in the throat portion B on the suction surface side is manufactured by a method to be explained below. As shown in FIG. 12, the cutter 21 formed to be tapered is used to, cut the suction surface side in the blade 34 from the front edge portion A of the blade 34, form the throat portion B in a convex shape (convex portion 35), and cut the blade 34 to the rear edge side. In this case, in a state in which the cutter 21 is rotated at a predetermined velocity, while the rotation axis O is moved, the cutter 21 cut the surface of the blade 34 thickness direction in two stages, whereby the throat portion B is formed in a ridge shape.

In this way, in the centrifugal compressor according to the second embodiment, on the suction surface side of the blade 34 in the impeller 31, the convex portion 35 is formed to assume a curved line from the front edge portion A to the throat portion B and to become a ridge shape substantially in the middle in the radial direction. Consequently, this convex portion 35 is formed in a position where a relative inlet velocity of fluid into the impeller 11 is Mach number Ma≅1.

Therefore, the throat width is reduced compared with conventional impeller in the middle of the impeller 31, a change in a flow path area in a direction of a flow of fluid is reduced, and a change in a flow rate per unit area is also reduced. Thus, an increase in a Mach number is controlled and a magnitude of a shock wave to be generated is also controlled, flow separation and distortion of a flow of the fluid decrease, and fall in efficiency and performance of the impeller 31 is prevented.

In addition, the cutter 21 formed to be tapered is applied to, cut the suction surface of the blade 16 from the front edge portion A toward the throat portion B, whereby the throat portion B is formed in the convex portion 35 of a ridge shape. Therefore, it is possible to perform machining of the suction surface of the blade 16 easily and in a short time.

Figure 13:
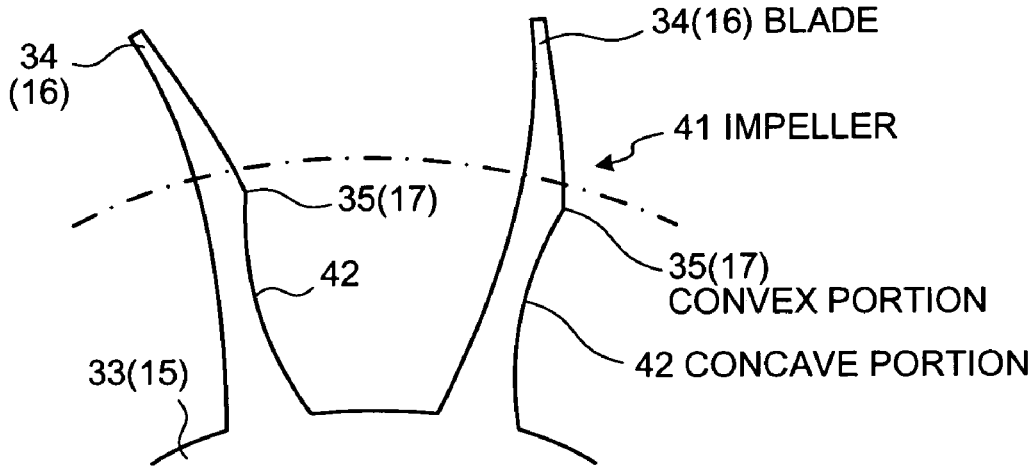
FIG. 13 is a sectional view of an impeller in a centrifugal compressor according to a third embodiment of the invention.

FIG. 13 is a sectional view of an impeller in a centrifugal compressor according to a third embodiment to the invention. Note that members having the same functions as those explained in the embodiments described above will be denoted by the identical reference numerals and signs and will not be explained repeatedly.

In the centrifugal compressor according to this embodiment, as shown in FIG. 13, in the impeller 31 according to the first embodiment the convex portion 35 is formed, or in the impeller 31 according to the second embodiment, the hub side of the convex portion 35 of the ridge shape is formed in a concave shape to form an impeller 41. In short, in the impeller 41 according to this embodiment, the convex portion 35 is formed to gradually become convex from the front edge portion to the throat portion on the suction surface in the blade 34. This convex portion 35 is formed same manner as the first embodiment 17, or same manner as the second embodiment to become a ridge substantially in the middle in the radial direction of the blade 34, that is, along a line on which a relative inlet velocity of fluid into the impeller 31 is Mach number Ma≅1. Further, a concave portion 42 to be concave toward the pressure surface side is formed such that a throat width on the hub side increases on the suction surface of this blade 34.

In this way, in the centrifugal compressor according to the third embodiment, on the suction surface side of the blade 16 or 34 in the impeller 41, the convex portion 17 or 35 is formed to assume a curved line from the front edge portion A to the throat portion B and to become a convex or ridge shape substantially in the middle in the radial direction, and the concave portion 42 with an increasing throat width is formed on the hub side of the convex portion 17 or 35. Therefore, since the throat width decreases in the middle of the impeller 41 and, on the other hand, the throat width increases on the hub side, a change in a flow path area in a direction of a flow of fluid decreases and a change in a flow rate also decreases. Thus, an increase in a Mach number is controlled and a magnitude of a shock wave to be generated is also controlled, flow separation and distortion of a flow of the fluid decrease, and fall in efficiency and performance of the impeller 11 is prevented. Therefore, it is possible to improve efficiency and performance of the impeller 11 or 31.

Figure 14:
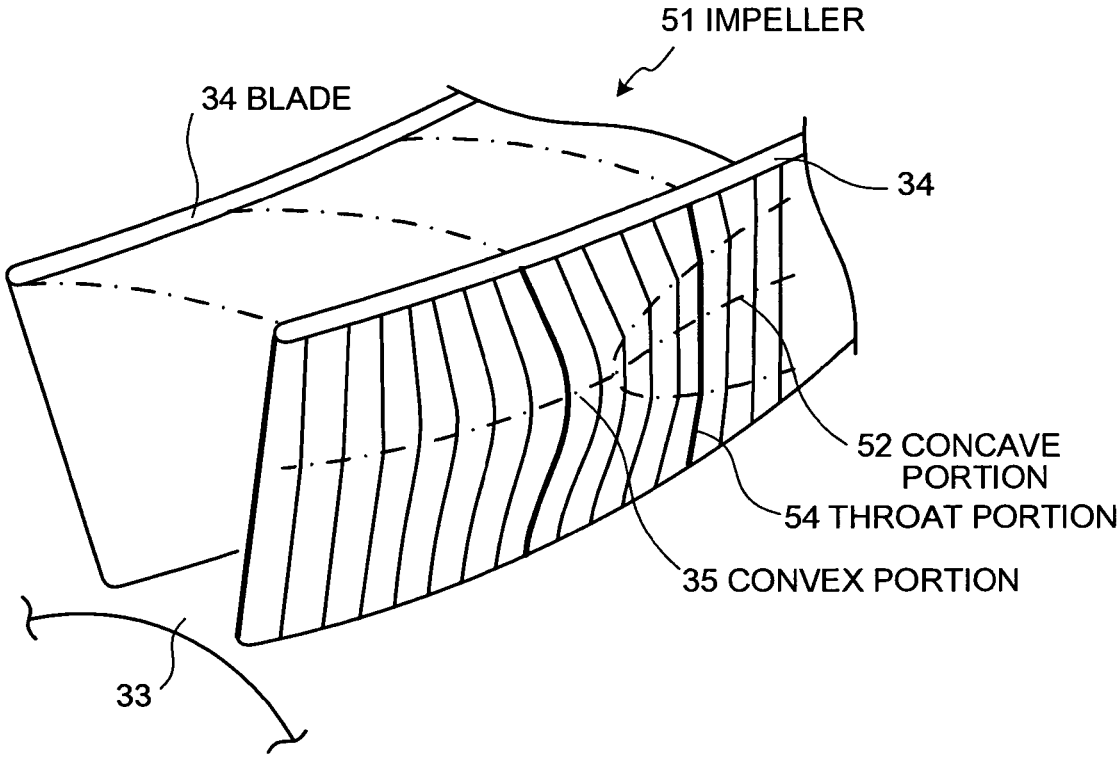
FIG. 14 is a schematic diagram of a centrifugal compressor according to a fourth embodiment of the invention.
Figure 15:
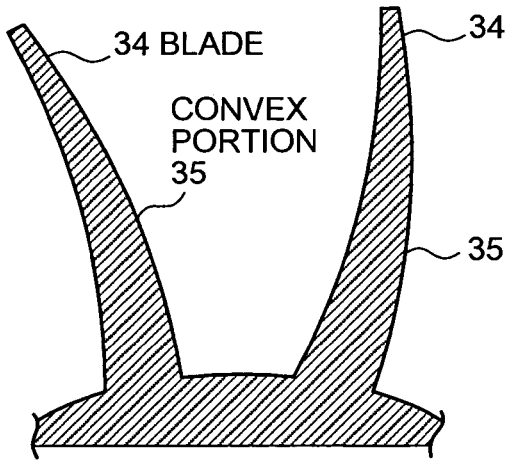
FIG. 15 is a sectional view in a front edge portion of the impeller according to the forth embodiment.
Figure 16:
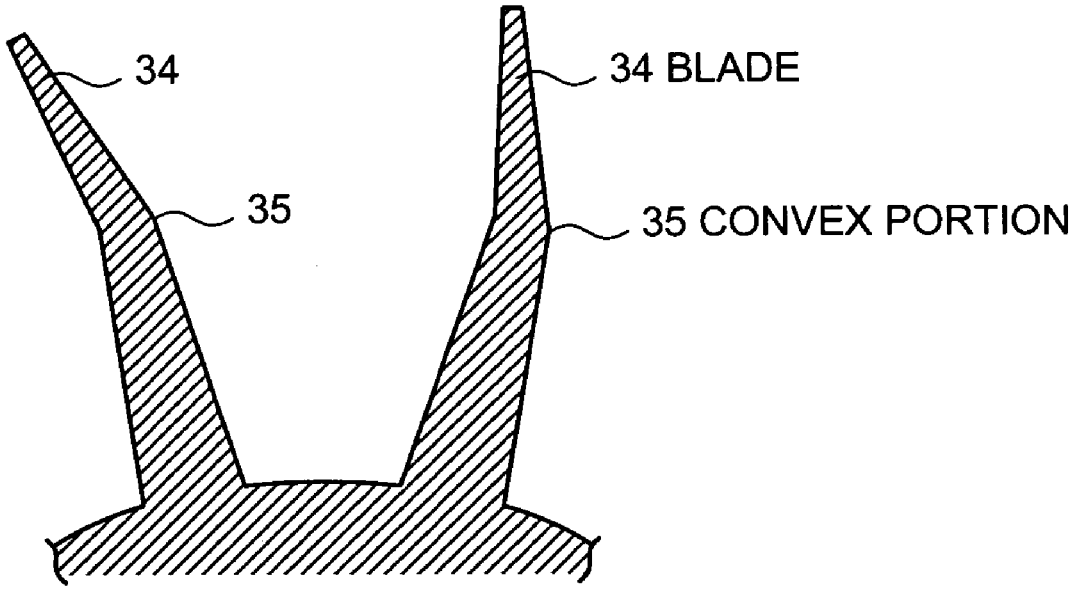
FIG. 16 is a sectional view in a throat portion of the impeller according to the forth embodiment.
Figure 17:
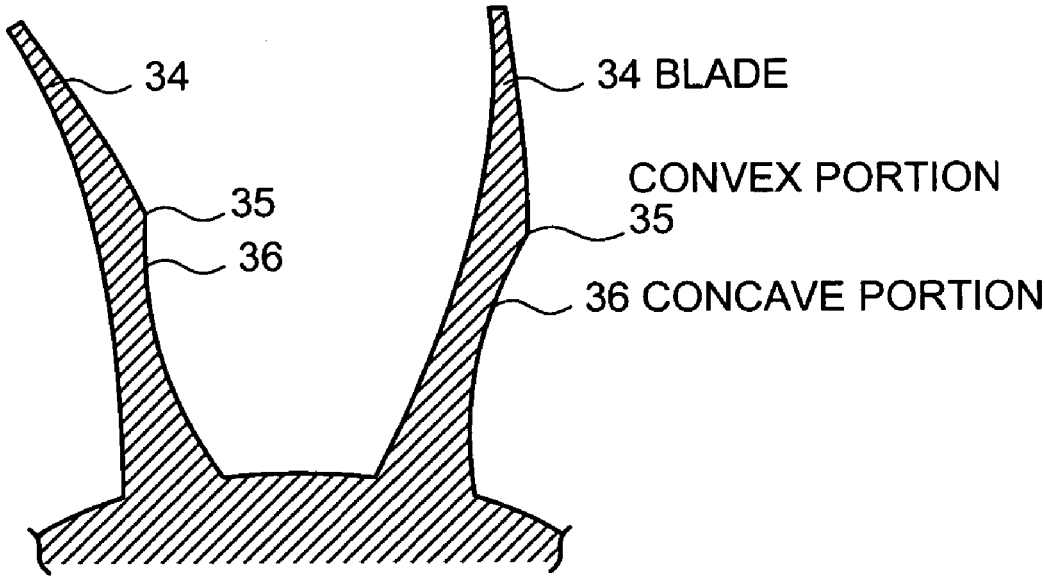
FIG. 17 is a sectional view in a rear edge portion of the impeller according to the forth embodiment.
Figure 18:
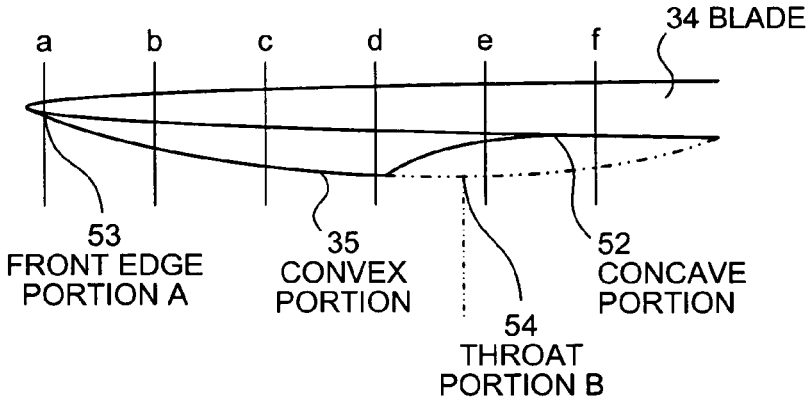
FIG. 18 is a plan view of a blade according to the forth embodiment.
Figure 19:
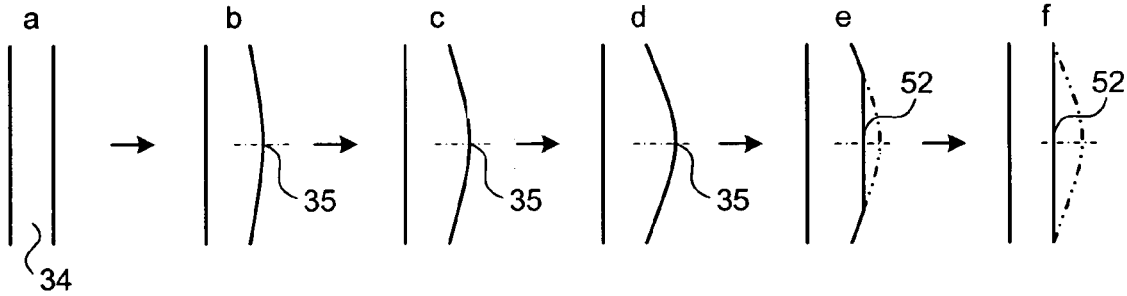
FIG. 19 is a schematic diagram of a change in a sectional shape of the blade according to the forth embodiment.
Figure 20:
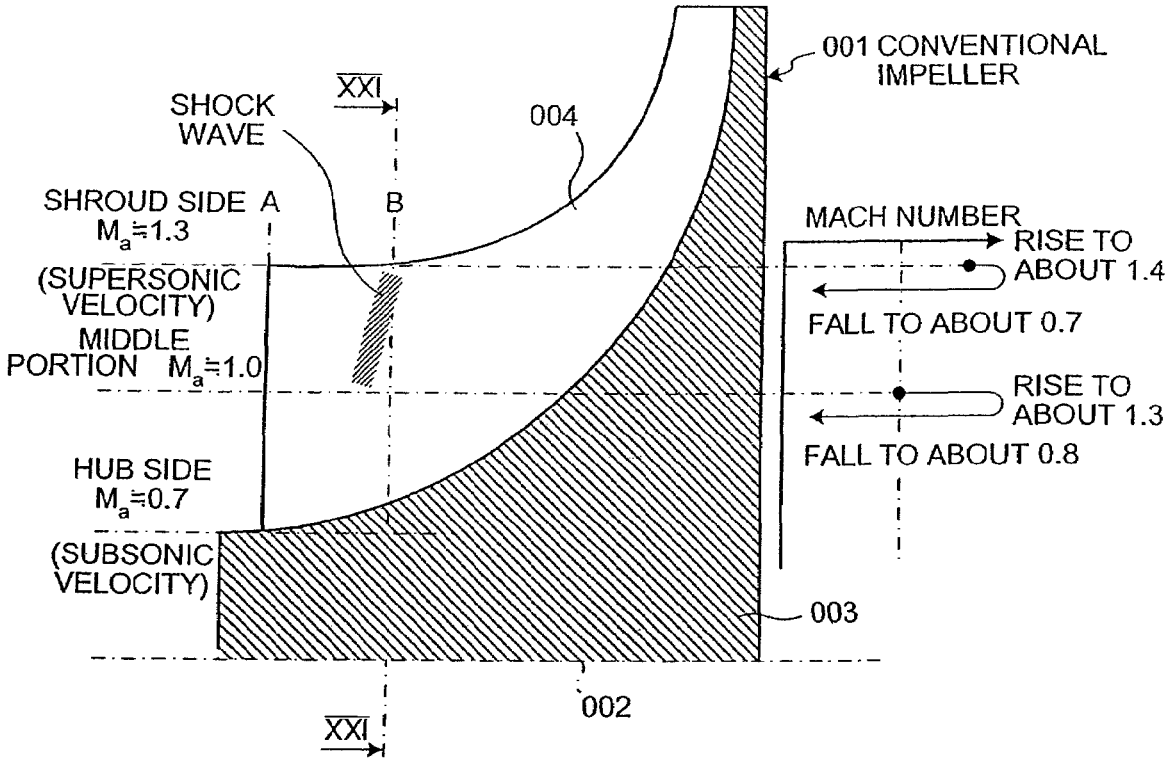
FIG.20 (PRIOR ART)
FIG. 20 is a sectional view of an impeller in a conventional centrifugal compressor.
Figure 21:
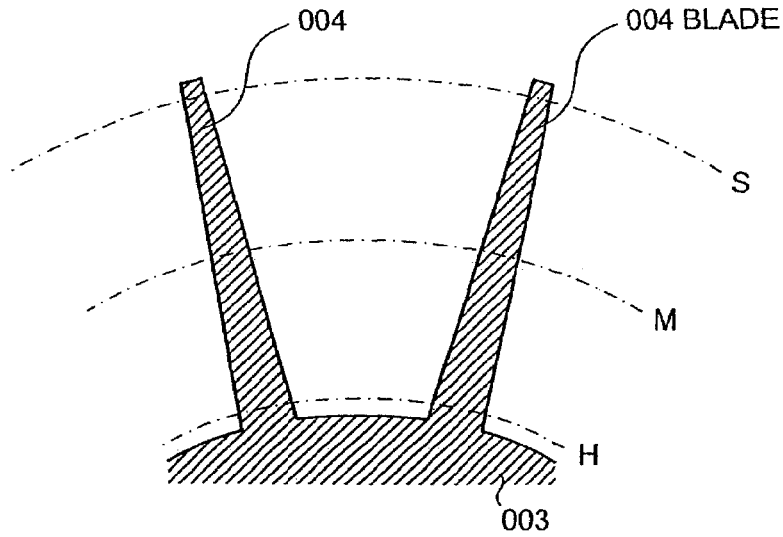
FIG.21 (PRIOR ART)
FIG. 21 is a sectional view along line XXI-XXI in FIG. 20.
Figure 22:
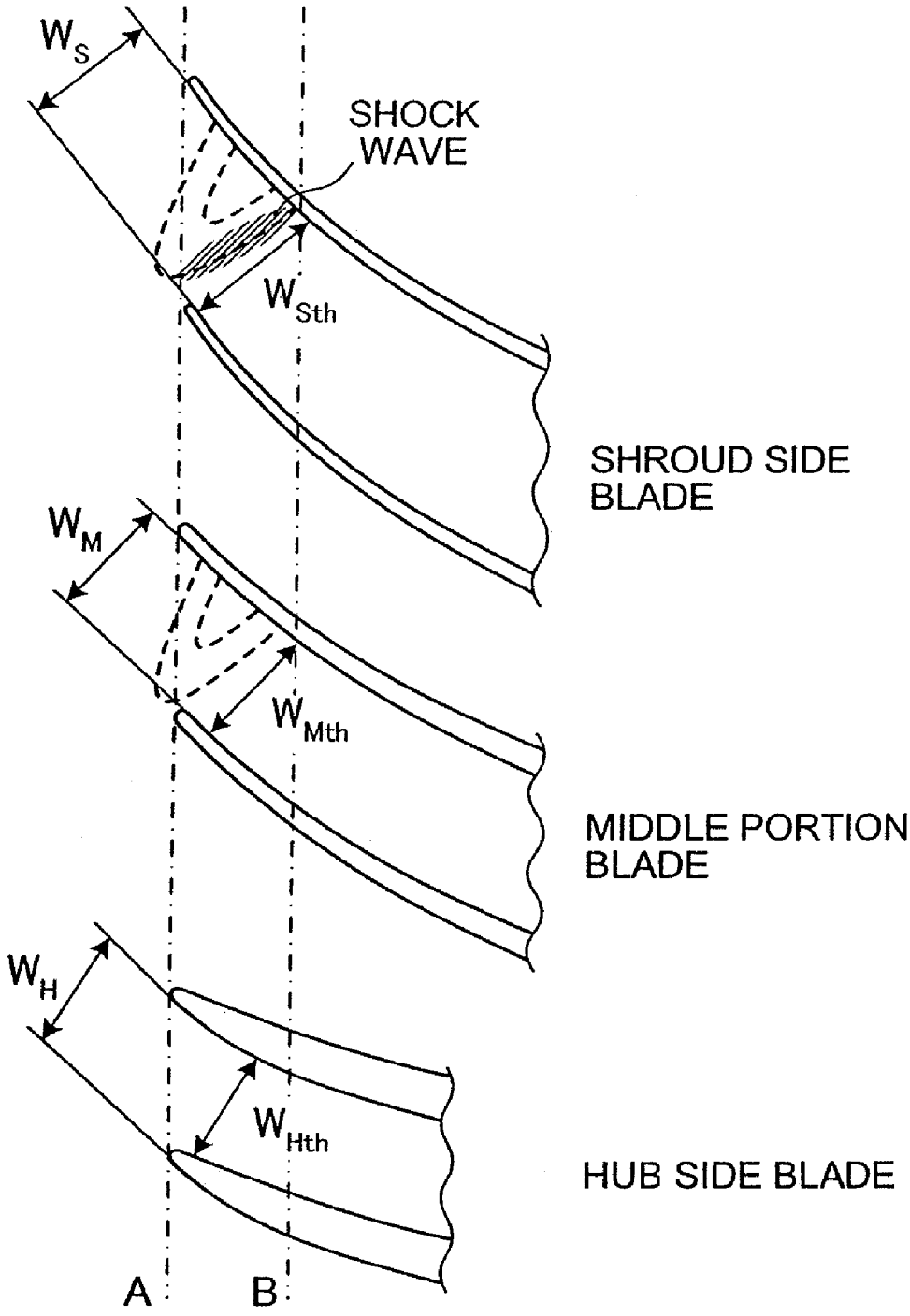
FIG.22 (PRIOR ART)
FIG. 22 is a schematic diagram of a shape in each position in a blade of a conventional impeller.

FIG. 14 is a schematic diagram of a centrifugal compressor according to a fourth embodiment of the invention. FIG. 15, FIG. 16 or FIG. 17 is a sectional view in a portion just upstream of throat of an impeller according to the forth embodiment. The convex portion 35 is formed in a same manner as first embodiment 17 or second embodiment 35 or third embodiment 35 with concave portion of 42 respectively. FIG. 18 is a plan view of a blade according to the forth embodiment. FIG. 19 is a schematic diagram of a change in a sectional shape of the blade.

In the centrifugal compressor according to this embodiment, as shown in FIGS. 14 , in the impeller according to the second embodiment, an impeller 51 is formed to gradually become flat from the throat portion, where the convex portion 35, that is similar to the convex portion of 17 in a first embodiment is formed, toward the rear edge portion. In short, in the impeller 51 according to this embodiment, this convex portion 35 is formed to gradually become convex from the front edge portion to the throat portion on the suction surface in the blade 34, and this convex portion 35 is formed to become a peak substantially in the middle in the radial direction of the blade 34, that is, along a line on which a relative inlet velocity of fluid into the impeller 51 is Mach number Ma≅1. Further, on the suction surface of this blade 34, a flat portion 52 is formed from the concave portion 35 in the throat portion to the rear edge portion to be a flat shape as in the conventional technology.

In this case, as shown in FIGS. 17 and 18, in the blade 34 of the impeller 51, the middle on the suction surface side gradually projects to expand in a part from the front edge portion to the throat portion 54 to form the convex portion 35(*a-d*) and, thereafter, forms the concave portion 52 to hollow out this convex portion 35(*d-f*), and becomes flat again.

In this way, in the centrifugal compressor according to the fourth embodiment, on the suction surface side of the blade 34 in the impeller 51, the convex portion 35 is formed from the front edge portion A53 to the throat portion B54 substantially in the middle in the radial direction, and the flat portion 52 is formed from the convex portion 35 just upstream of this throat portion B54 to the rear edge portion to shift to a flat shape. Consequently the throat width in the middle of the impeller 51 increases compared with first to forth embodiment. Thus, an increase in a Mach number is controlled and a magnitude of a shock wave to be generated is also controlled, as same manner of effect of convex portion 35 and flow separation and distortion of a flow of the fluid decrease. Therefore, it is possible to improve efficiency and performance of the impeller 31.

Note that, in the respective embodiments described above, the throat portion on the suction surface side in the blade is formed in a convex shape, and the pressure surface side is formed in a concave shape. However, in the invention, the throat portion on the suction surface side in the blade only has to be formed relatively in a convex shape. In other words, the pressure surface side may be formed in a flat surface or formed in a convex shape Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A centrifugal compressor that has an impeller, which is mounted with plural blades on an outer periphery of a hub in such as manner as to radially protrude from the center axis of the hub, disposed in an inside of a casing and pressurizes fluid introduced into the casing according to rotation of the impeller and discharges the fluid, wherein each of the blades is deflected from a leading edge portion toward a throat portion when observed at any given radius from the center axis, the sectional surface of said leading edge portion of the blade in the radial direction being straight, a throat portion on a side of the a suction surface of each of the blades includes a convex portion that is more convex in a radial direction than other portions of the blade, and the convex portion is at a middle portion in the radial direction of the blade.

2. The centrifugal compressor according to claim 1, wherein a relative inlet Mach number of fluid into the impeller around the convex shape is around 1, on the suction surface side of the blade.

3. The centrifugal compressor according to claim 1, wherein the convex shape on the suction surface side in the blade is formed substantially in the middle in the radial direction of the blade in such a manner as to gradually become convex, assume a curved line from the leading edge portion to the throat portion, and also to gradually become flat from the throat portion to a rear edge portion of the blade.

4. The centrifugal compressor according to claim 1, wherein the convex portion forms a ridge substantially in the middle of the blade, preferably along a midde line of the blade.

5. The centrifugal compressor according to claim 1, wherein the suction surface side of the blade formed in the convex shape gradually becomes convex from a front edge portion toward the throat portion.

6. The centrifugal compressor according to claim 5, wherein the suction surface side of the blade formed in the convex shape gradually becomes flat from the throat portion toward a downstream portion.

7. The centrifugal compressor according to claim 5, wherein the suction surface side of the blade is formed to gradually become concave from the throat portion formed in the convex shape toward a downstream portion.

8. The centrifugal compressor according to claim 1, wherein, in the throat portion on the suction surface side in the blade, the hub side is formed in a concave shape.

* * * * *